United States Patent [19]

Jackson

[11] B 3,983,808

[45] Oct. 5, 1976

[54] METHOD AND APPARATUS FOR APPLYING FLEXOGRAPHIC PRINTING PLATES TO THE PRINTING CYLINDERS OF A MULTI-CYLINDER PRINTING MACHINE

[75] Inventor: John Maxwell Jackson, Potters Bar, England

[73] Assignee: Chromax Ltd., Watford, England

[22] Filed: Aug. 2, 1974

[21] Appl. No.: 494,234

[44] Published under the second Trial Voluntary Protest Program on February 10, 1976 as document No. B 494,234.

Related U.S. Application Data

[63] Continuation-in-part of Ser. No. 309,688, Nov. 27, 1972, abandoned.

[30] Foreign Application Priority Data

Dec. 2, 1971 United Kingdom ..... 55992/71

[52] U.S. Cl. ..... 101/401.3; 101/DIG. 12

[51] Int. Cl.[2] ..... B41L 37/04; B41L 29/06; B41L 29/20

[58] Field of Search ..... 101/33, 415.1, 401.1, 101/401.2, DIG. 12, 212, 216, 378, 401.3

[56] References Cited

UNITED STATES PATENTS

| | | | |
|---|---|---|---|
| 414,991 | 11/1889 | Parker et al. | 156/446 |
| 1,295,016 | 2/1919 | Eastman et al. | 156/446 |
| 1,421,360 | 7/1922 | Biery | 101/378 |
| 1,480,489 | 1/1924 | Banzett | 101/415.1 |
| 2,192,924 | 3/1940 | Maher et al. | 101/415.1 X |
| 2,418,007 | 3/1947 | Barnes et al. | 101/426 |
| 2,539,965 | 1/1951 | Moss et al. | 101/DIG. 12 |
| 2,689,411 | 9/1954 | Huck | 101/DIG. 12 |
| 2,694,975 | 11/1954 | Garver | 101/381 X |
| 2,711,691 | 6/1955 | Leavens, Jr. | 101/DIG. 12 |
| 2,916,990 | 12/1959 | Dubois | 101/415.1 |
| 3,161,129 | 12/1964 | Taylor | 101/212 |
| 3,361,060 | 1/1968 | Hoexter et al. | 101/216 |
| 3,390,633 | 7/1968 | Boughton | 101/401.1 |
| 3,533,355 | 10/1970 | Wall | 101/415.1 |

*Primary Examiner*—Edgar S. Burr
*Assistant Examiner*—Paul J. Hirsch
*Attorney, Agent, or Firm*—Browdy and Neimark

[57] ABSTRACT

Apparatus for mounting flexographic printing plates by adhesive on the printing cylinders of a multi-cylinder printing machine has a rotatable hub for supporting each of the cylinders in turn, a platform for supporting each printing plate in a plane tangential to a cylinder on the hub, the platform being movable to cause the cylinder to roll along the plate so that adhesive on the plate or cylinder causes the plate to adhere to and wrap around the cylinder, and rack and pinion gearing between the rotatable hub and the movable platform. The hub has axial and radial abutments engageable with corresponding axial and radial abutments on the cylinders, and the platform has index pins engageable in apertures in the printing plates, the apertures in each plate being in the same position relative to the area of the plate corresponding to the total design to be printed, so that the printing media on the plates on the cylinders will be in register with one another for printing purposes when the cylinders are mounted on the printing machine with their axial and radial abutments in register with one another. The pins engageable in apertures in opposite ends of each printing plate are relatively movable away from one another to enable the pins to be set apart at a distance such that all the plates are stretched to exactly the same length when mounted on the platform.

8 Claims, 5 Drawing Figures

METHOD AND APPARATUS FOR APPLYING FLEXOGRAPHIC PRINTING PLATES TO THE PRINTING CYLINDERS OF A MULTI-CYLINDER PRINTING MACHINE

CROSS REFERENCE TO RELATED APPLICATIONS

This application is a continuation-in-part of co-pending application Ser. No. 309,688, filed Nov. 27, 1972, now abandoned.

FIELD OF THE INVENTION

This invention relates to flexographic printing and is concerned more particularly with a method and apparatus for applying flexographic printing plates to the printing cylinders of a multi-cylinder printing machine.

BACKGROUND OF THE INVENTION

In U.S. Pat. No. 3,645,201 there is described and illustrated a multi-cylinder printing machine in which each printing cylinder is detachably mounted on a hub member of the machine, the cylinder having axial and radial abutments in engagement with corresponding axial and radial abutments on the hub member. The axial and radial abutments on each hub are in register with the corresponding axial and radial abutments on the other hub members whereby the printing cylinders may be interchanged or exchanged with other cylinders without loss of registration of the images printed by the cylinders. For convenience, a multi-cylinder flexographic printing machine having such axial and radial abutments on the hub members and cylinders will be referred to hereinafter as a multi-cylinder printing machine of the type described.

In the machine of the type described, it is of course essential that the printing plates on the cylinders be accurately positioned relative to the radial and axial abutments on the cylinders to ensure registration of the images printed by the different cylinders.

The printing plates are generally secured to the printing cylinders by adhesive so that the plates can readily be removed and refitted to the cylinders. Hitherto, the printing plates have been positioned on the cylinders by trial and error, the machine being used to print with the plates and any errors in registration of the images printed by the plates corrected by removing and refitting the plates. This is however a slow and laborious operation since, in addition to aligning the plates accurately relative to the abutments, it is frequently necessary to stretch some of the plates. Flexographic printing plates cannot be made with great precision due to the fact that they are molded from flexible material under heat and the shrinkage which occurs on cooling of the mold is not identical for all plates.

SUMMARY OF THE INVENTION

The object of the present invention is to provide an improved method and apparatus for accurately positioning flexographic printing plates relative to the axial and radial abutments on the printing cylinders of a machine of the type described to ensure accurate registration of the images printed by the different cylinders.

According to the invention there is provided a method of mounting flexographic printing plates on the printing cylinders of a muti-cylinder printing machine of the type described, comprising:

stretching the flexographic printing plate into a taut condition and supporting the plate in the taut condition on a platform at a precisely predetermined position thereon with the print on the plate facing the platform;

mounting the cylinder at a precisely predetermined position on a rotatable hub having axial and radial abutments engageable with axial and radial abutments on the cylinder, said hub having a precisely predetermined position relative to said platform, the surface of the printing plate facing away from the platform being tangential to the surface of the cylinder;

coating the surface of the cylinder or the last mentioned surface of the printing plate with adhesive;

moving said platform and said hub relative to one another to effect rolling of the cylinder along the printing plate whereby the printing plate adheres to the cylinder at a precisely predetermined position relative to the axial and radial abutments thereon;

removing the cylinder from said hub;

stretching another flexographic printing plate to a length precisely equal to that of the first mentioned plate in the taut condition and mounting the other plate on the platform; and repeating said mounting, coating, moving and removing steps with said other plate and another cylinder, whereby all the printing plates fitted on cylinders have precisely the same length, and the radial and axial abutments on each cylinder fitted with a plate are in the same spatial relationship relative to the area of the plate corresponding to the total design to be printed, so that the printing media on the plates on the cylinders will be in register with one another for printing purposes when the cylinders are mounted on the printing machine.

The printing plate which is the longest in the unstretched condition is preferably the first to be mounted on a cylinder, this plate being stretched by an amount just sufficient to bring it into a taut condition. In this way the plates are stretched by the minimum amount necessary to obtain exact registration. In a case in which the design must subtend a predetermined angle on the cylinder each plate is of course stretched to the required length.

According to the invention there is also provided apparatus for mounting flexographic printing plates by adhesive on the printing cylinders of a multi-cylinder printing machine of the type described, the apparatus comprising a base, a hub rotatably mounted on support means on the base, said hub having axial and radial abutments engageable with axial and radial abutments on a printing cylinder mounted on the hub, a platform on said base, first index means and second index means supported on the platform and engageable with opposite ends of a printing plate to hold the plate in a taut condition tangential to a printing cylinder amounted on the hub, at least one of said first and second index means being movable along the platform to adjust the distance between the first and second index means and thereby adjust the tension in a printing plate mounted on the index means, both of said first and second index means permitting removal of the plate therefrom in a direction away from the platform, a gear pinion secured to the hub for rotation therewith, and a rack on the platform and in mesh with the pinion, said platform and said hub being relatively movable with the gear pinion rolling along the rack, and the diameter of the pitch circle of the gear pinion being substantially equal to the sum of the diameter of the printing cylinder and the thickness of the printing plate, whereby in operation with said radial and axial abutments on a cylinder engaged against said radial and axial abutments on the hub, a printing plate fitted on the first and second index means with the spacing between the index means adjusted so that the plate is held taut, and the cylinder and/or the top surface of the plate coated with adhesive, the plate adheres to and wraps around the cylinder as the cylinder rolls along the plate, with the plate in a predetermined spatial relationship relative to the radial and axial abutments on the cylinder.

The hub is preferably rotatably mounted about an axis fixed relative to the base, and the platform movable along a track on the base. The platform may however be fixed and the hub mounted so as to be movable along the platform. The first and second index means can conveniently comprise pins mounted to the platform and engageable in apertures in the ends of the printing plate. Alternatively, the plate may be provided with studs engageable in apertures in the platform.

With the apparatus of the invention, each cylinder of a multi-cylinder printing machine of the type described can be fitted with a printing plate in a very short time without requiring the exercise of any particular skills, all the printing plates being exactly in register for printing purposes when the cylinders are refitted to the machine.

One construction of apparatus according to the invention and suitable for use in applying flexographic printing plates to the printing cylinders of the multi-cylinder printing machine illustrated in U.S. Pat. No. 3,645,201 will now be described, by way of example, with reference to the accompanying drawings, in which:

DETAILED DESCRIPTION OF PREFERRED EMBODIMENTS

Figure 1:
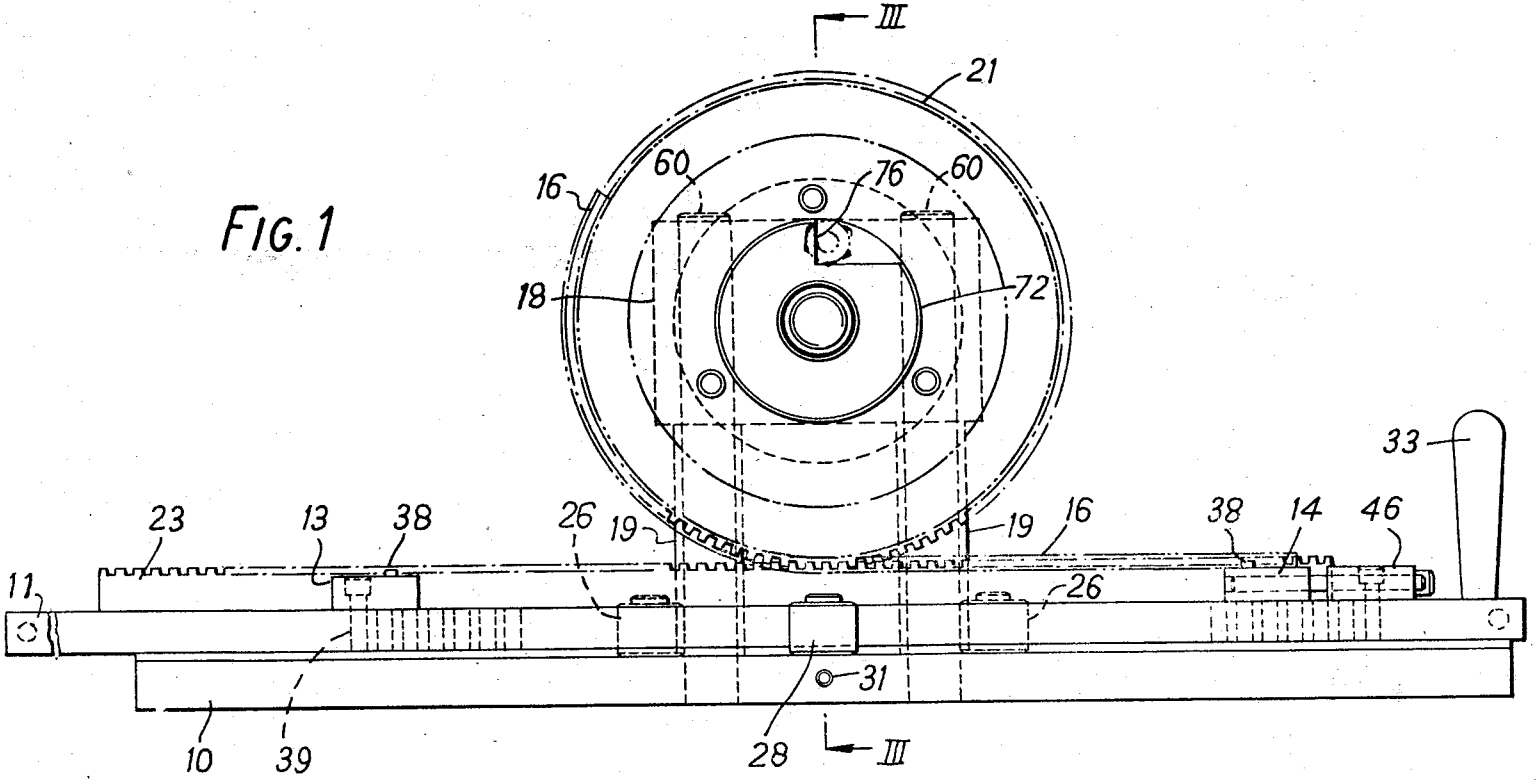
FIG. 1 is a front elevation of the apparatus.
Figure 2:
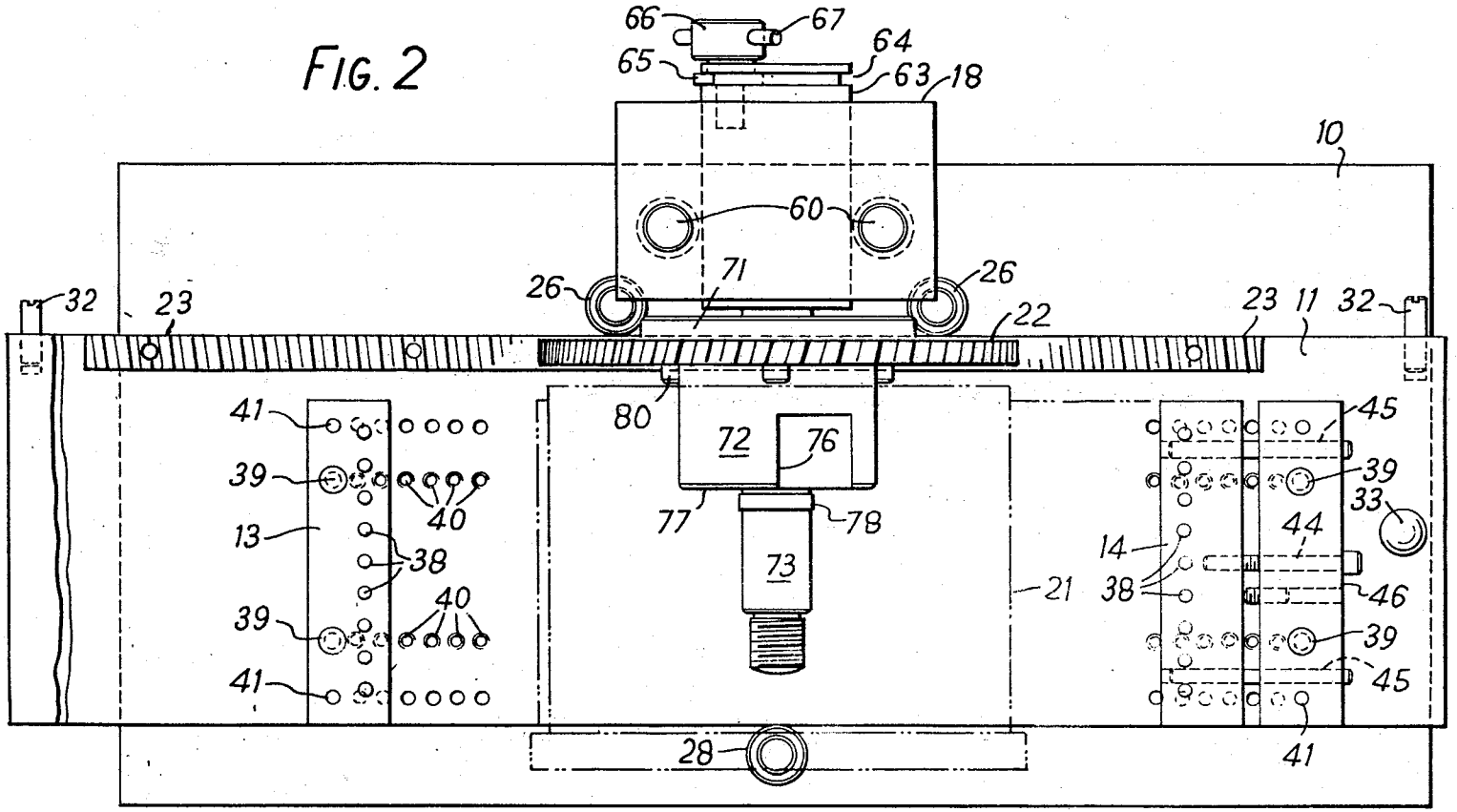
FIG. 2 is a plan view of the apparatus.
Figure 3:
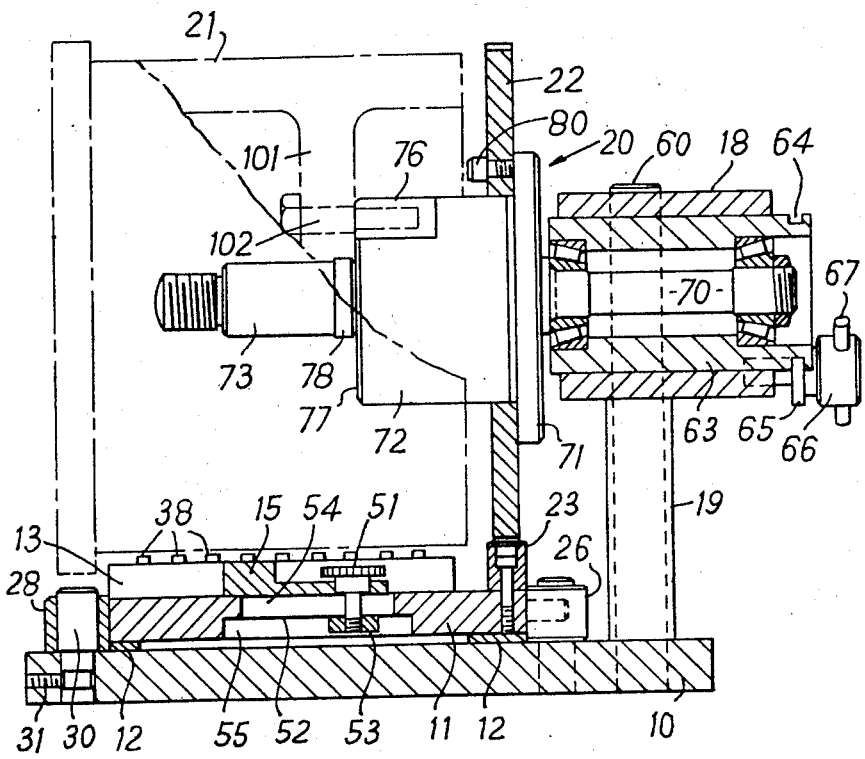
FIG. 3 is a sectional view of the apparatus taken along the line III—III in FIG. 1.

Referring to FIGS. 1–3, the apparatus comprises a base plate 10, a slide 11 movable along two parallel rails 12 extending from side to side on the base plate and forming a track for the slide, the slide having two terminal locating bars 13, 14 and an intermediate locating bar 15 (FIG. 3) for positioning a flexographic printing plate 16 on the top of the slide 11 (the bar 15 is omitted from FIG. 1 and 2 in order to illustrate other parts of the apparatus more clearly), a bearing block 18 mounted on two pillars 19 at the rear of the base plate, a hub member 20 rotatably mounted in the bearing block, the hub member extending horizontally forwards over the slide 11 and being adapted to support a printing cylinder 21 to which a flexographic printing plate is to be attached, and a gear pinion 22 secured to the hub member 20 and in mesh with a toothed rack 23 on the slide.

The base plate 10 is substantially rectangular and arranged with the longer dimension thereof extending from side to side of the apparatus, the rails 12 extending longitudinally along the length of the base plate. The rails 12 are made of low friction material, for example polytetrafluoroethylene. The base plate is also fitted with a pair of guide rollers 26 which engage the rear edge of slide 11 and a third roller 28 which engages the front edge of slide 11, the roller 28 being mounted on an eccentric pin 30 secured in an aperture in the base plate. The rollers locate the slide on the rails 12 and permit the slide to move freely from side to side along the base plate. The distance between the roller 28 and the pair of rollers 26 can be varied by angular adjustment of the eccentric pin 30 of the roller 28 so as to take up any clearance between the rollers and the slide. The pin 30 is located in any set position by a grub screw 31 (FIG. 3). The rear wall of the slide is fitted with two stop pins 32 arranged one at each end of the slide and adapted to engage the pair of rollers 26 at the end of the path of travel of the slide. The toothed rack 23 is secured to the top of the slide adjacent the rear edge thereof, and a handle 33 is secured to one end of the slide.

The two terminal locating bars 13, 14 are mounted on the top of the slide with their longitudinal axes extending in a fore and aft direction, and are spaced apart a distance corresponding to the length of the flexographic plates to be applied to the printing cylinders. The bar 13 is spaced from the adjacent end of the slide for a purpose described hereinafter. Each bar 13, 14 is provided with a row of upright pins 38 extending along the length of the bar and adapted to engage in corresponding apertures in an end of a flexographic printing plate. The bar 13 is secured to the slide by two screws 39 engaged in screw threaded bores 40 in the slide and is accurately aligned with its longitudinal axis in the fore and aft direction by dowel pins 41 engaged in co-operating apertures in the ends of the locating bar and in the slide. The slide is provided with several sets of bores for reception of the screws 39 and dowel pins 41 on the bar 13, to enable the bar to be secured at different positions to accommodate printing plates of different lengths. The locating bar 14 rests on the slide and is connected by a screwed rod 44 and two guide rods 45 to an anchor bar 46 arranged parallel to the bar 14, the anchor bar being positioned to the right of bar 14 and secured to the top of the slide by screws 39 and dowel pins 41 in a manner identical to that by which the bar 13 is secured to the slide. As with the locating bar 13, the slide is provided with several sets of bores for reception of the screws 39 and dowel pins 41 on the anchor bar 46 to enable the anchor bar to be secured at different positions along the slide. The two guide rods 45 are rigidly secured to the bar 14, one adjacent each end of the bar, and the guide rods extend as a close sliding fit through bores in the anchor bar 46 so as to maintain the locating bar 14 parallel to the anchor bar 46. The screwed rod 44 extends through a bore in the anchor bar 46 and is screwed into a screw threaded bore in the locating bar 14, the screwed rod 44 having a head which abuts against the right hand side of the anchor bar.

Figure 4:
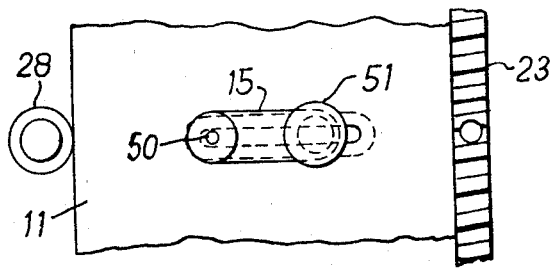
FIG. 4 is a plan view of part of the slide of the apparatus showing the intermediate locating bar.

The intermediate locating bar 15 (FIGS. 3 and 4) rests on the center portion of the slide 11 and is arranged substantially parallel to the terminal locating bars 13, 14. The front end of bar 15 is provided with an upright pin 50 (FIG. 4) adapted to engage in an aperture in the center portion of a printing plate. The top surface of the rear portion of the bar 15 is cut away to accommodate the head of a screw 51 on which the bar is pivotally mounted. The screw 51 extends downwards into a slot 52 in the slide and is fitted at its lower end with a nut 53. The slot 52 extends substantially perpendicular to the longitudinal axis of the slide and has an upper portion 54 which is of narrower width than the lower portion 55. The screw 51 is a close sliding fit in the upper portion 54 of the slot and the nut 53 is a close sliding fit in the lower portion 55 of the slot. The nut 53 engages against the shoulder between the upper and lower portions of the slot. The head of the screw 51 has a knurled rim to facilitate turning the screw by hand.

The bearing block 18 has two vertical bores which receive as a close sliding fit two vertical guide rods 60 secured on the base plate to the rear of the slide, the tubular pillars 19 which support the block 18 being fitted on the guide rods and resting on the base plate. The height of the bearing block can thus be varied by replacing the pillars with others of different length. The bearing block also has a relatively large horizontal bore which extends fore-and-aft through the center of the block and receives a sleeve 63 as a close sliding fit therein. The sleeve projects rearwardly beyond the bearing block and is provided at the rear end thereof with a groove 64 in which is engaged a flange 65 on the shank of a bolt 66 screwed into the rear end wall of the bearing block. Screwing the bolt 66 into or out of the block 18 thus causes the flange 65 to move the sleeve forwards or rearwards. The head of the bolt is fitted with radial spokes 67 to facilitate rotation of the bolt 66.

The hub member 20 comprises a shaft 70 having an annular flange 71 at the front end thereof, a large cylindrical boss 72 on the front of the flange 71, and a spindle 73 on the front end of the boss, the shaft 70, flange 71, boss 72 and spindle 73 all being co-axial. The shaft 70 is rotatably mounted by two roller bearings in the sleeve 63 in the bearing block. The periphery of the front end portion of the boss 72 is cut away along a radial plane, and along a further plane normal to this radial plane, to provide a radial abutment 76 which lies along a radial plane containing the axis of the hub member. The front end wall of the boss 72 provides an axial abutment 77 for a cylinder mounted on the hub member. The spindle 73 has an annular seat 78 of a slightly larger diameter adjacent the boss 72, and the front end of the spindle 73 is of reduced diameter and formed with a screw thread for reception of a clamping nut (not shown).

The gear pinion 22, which is annular in form, is a close fit on the boss 72 and is rigidly secured to the flange 71 by bolts 80. The teeth of the gear pinion are in mesh with the rack 23 on the slide.

Figure 5:
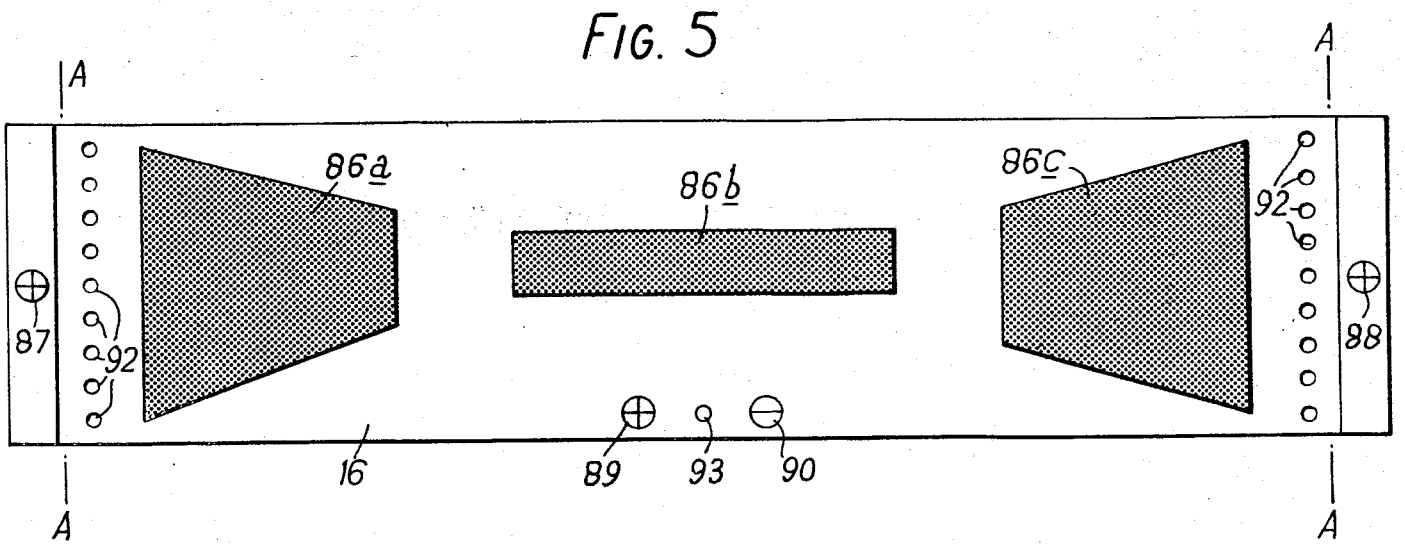
FIG. 5 is a plan view of a printing plate for the apparatus.
Figure 6:
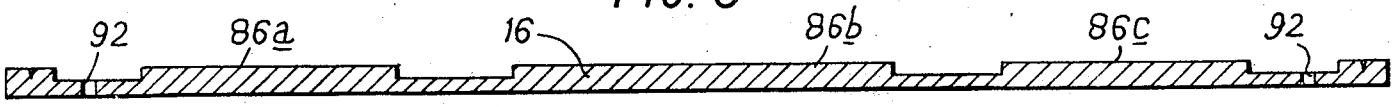
FIG. 6 is a side view of the printing plate of FIG. 5, shown in section along the longitudinal center line of the plate.

The flexographic printing plates are prepared from a drawing or photograph of the design to be printed, but the drawing or photograph also includes index marks which are used to locate the positions of apertures in the printing plates for reception of the pins 38, 50 on the locating bars 13, 14, 15. Each printing plate is made in known manner by etching part of the design and all the index marks on a copper or zinc plate, forming a matrix of hard bakelite from the copper or zinc plate, and molding a plate in rubber from the bakelite matrix, the length of the molded plate being greater than that required for the final printing plate. FIGS. 5 and 6 show a rubber plate moulded from such a matrix and having thereon three parts 86*a*, 86*b*, 86*c* of a design, two index marks 87, 88 on the end portions of the plate and two further index marks 89, 90 on one side of the plate, the design parts and index marks being formed on raised portions on the top surface of the rubber plate. Two rows of apertures 92 for reception of the pins 38 on the bars 13, 14 and an aperture 93 for reception of the pin 50 on the bar 15 are then punched in the plate, the apertures being accurately positioned on the plate by reference to the index marks. The apertures can conveniently be punched in a jig in which the plate is accurately positioned by reference to the index means. The rows of apertures 92 are punched in the parts of the plate between the index markers 87, 88 and the adjacent design parts, and the end portions of the plate having the index marks 87, 88 are then cut off along the line A—A in FIG. 5 to form a printing plate 16 of the desired length with the apertures 92 adjacent the ends of the printing plate. The index marks 89, 90 are removed from the printing plate by cutting underneath the marks with a knife. The bottom surface of the plate is smooth throughout its length, and is coated with a layer of pressure sensitive adhesive.

Printing plates manufactured by the method described above are generally not exactly the same length, even though the molds are the same length. The reason for this is that there is unequal shrinkage of the rubber or other flexible material forming the plate upon cooling of the mold. Preferably, the length of each of the plates is measured while the plate is in an untensioned condition and the longest plate fitted first to a cylinder as explained hereinafter.

The apparatus is prepared for use by positioning the two bars 13, 14 on the slide 11 and spaced apart a distance approximately equal to the length of each printing plate 16, rigidly securing the bar 13 and the anchor bar 46 to the slide as previously described, mounting the longest printing plate 16 on the bars 13, 14 with the pins 38 thereof engaged in the apertures 92 in the ends of the printing plate, the plate being arranged with the printing media on the lower face thereof, and the layer of pressure sensitive adhesive on the upper face. The intermediate locating bar 15 is then moved backwards or forwards along the slot 52 to a position in which the pin 50 is engaged in the aperture 93 in the printing plate, and the screw 51 is then rotated so as to clamp the head of the screw against the top of the slide 11 and the nut 53 against the shoulder in the slot 52. The locating bar is then restrained against forward or rearward movement, as is also the center portion of the printing plate engaged with the pin 50, but the printing plate is free to stretch longitudinally with the front end of the bar 15 pivoting about the screw 51. The locating bar 14 is then moved by screwed rod 44 along the slide by the smallest distance necessary to hold the printing plate taut on the pins 38, that is under tension. The slide 11 is moved to the right hand end of its path of travel, in which position the bar 13 is offset to the right of the hub member 20, and a printing cylinder 21 (shown in broken lines in FIGS. 1–3) is mounted on the hub member. The bearing block 18 is adjusted to a height at which the top surface of the printing plate is tangential to the surface of the printing cylinder to which the plate is to affixed, the block being supported at this height by pillars 19 of suitable length as previously described. The gear pinion 22 is of a size such that it is in mesh with the rack 23 on the slide and has a pitch circle of a diameter equal to the aggregate of the diameter of the printing cylinder 21 and the thickness of the printing plate 16, so that the longitudinal center line of the plate 16, that is the longitudinal line midway between the top and bottom surfaces of the plate, lies in a plane which is tangential to the pitch circle of the gear pinion 22. The printing cylinder 21 has a transverse web 101 provided with a central aperture in which the annular seat 78 on the spindle of the hub member engages as a close fit. The web 101 forms an axial abutment which engages the axial abutment 77 on the hub member. The radial abutment on the cylinder comprises a bolt 102 secured in an aperture in the web 101 and projecting into the cut-out in the boss 72, the bolt engaging against the wall of the cut-out which forms the radial abutment 76 on the hub member, as previously described. The printing cylinder is secured in position on the hub member by a nut (not shown) screwed on the end of the spindle 73 and clamping the web of the cylinder against the abutment 77 on the hub member.

When the printing plate 16 and printing cylinder 21 are mounted in position on the apparatus, the slide is moved to the left by means of the handle so that the cylinder rolls along the plate. The pressure sensitive adhesive coating on the plate causes the plate to stick to and become wrapped around the cylinder, the plate being lifted away from the pins 38, 50 on the locating bars 13, 14, 15.

The axial position of the printing plate on the printing cylinder is determined by the axial position of the sleeve 63 in the bearing block, which may be adjusted by rotation of the bolt 66 as previously explained.

Each of the printing cylinders may then be fitted in turn with their printing plates, merely by mounting the plate on the locating bars, and the cylinders on the hub member, with the slide in its right hand position, and then moving the slide back to the left hand position. Each plate will of course be in a taut condition, that is in tension, when mounted on the locating blocks 13, 14 since these blocks were set up in position with the longest plate in a taut condition. Each printing cylinder then has the printing plate fixed thereon with the part of the plate corresponding to the total design located in exactly the same spatial relationship to the axial and radial abutments on the cylinder. Thus when the cylinders are fitted to the printing machine, the part of each plate corresponding to the total design will overlie the same part of an article being printed so that the individual parts of the design on each plate will be in register for printing purposes.

The adhesive on the printing plates is preferably of a type which permits the plates to be peeled off the cylinders and remounted for subsequent use.

The apparatus may of course be used to apply printing plates to printing cylinders of any particular size, by mounting the bearing block at a height at which the top surface of a printing plate on the slide is tangential to the cylinder mounted on the hub member, and replacing the gear pinion by one having a pitch circle diameter equal to the aggregate of the diameter of the printing cylinder and the thickness of the printing plate.

It is necessary for the pitch circle diameter of the gear pinion to be equal to the mean diameter of the printing plate when wrapped around the cylinder to ensure that the original stretch applied to the plate for correction purposes is neither increased nor decreased by the rolling-on operation. If the gear pitch diameter is less than the mean plate diameter additional stretch will be applied to the plate during mounting, if it is greater the original stretch will be relaxed as the plate is rolled on. In either case register will be adversely affected. To facilitate achieving this precise relationship helical gearing is used, as with such gearing it is possible to obtain any desired tooth pitch by using a standard gear module and selecting an appropriate helix angle. The calculations involved in arriving at the helix angle are well known to those versed in the art of gearing.

It is often desirable when printing cylindrical or frusto conical articles to make both ends of the design meet as precisely as possible. In order to achieve such accuracy with the machine described in U.S. Pat. No. 3,645,201 it is necessary for the printing arc to subtend an angle of exactly 180° on the printing cylinder. In normal practice this is very difficult to achieve but with the apparatus described herein it is possible to stretch the printing plate to a uniform and precise degree prior to mounting by drawing bar 14 away from bar 13 by means of the screwed rod 44.

In practice the designs are drawn and plates are made to leave a slight gap in the design when wrapped around the article. The first step in establishing the amount of stretch required to make the design meet is to mount on of the plates of a set on a cylinder with minimum stretch and carry out a quick run on the printing machine. The gap in the printed image at the joint line may then be measured and a similar adjustment applied to the position of the locating bar 14. At the same time the axial position of the design on the container may be checked and if an adjustment is required a similar correction applied to the axial position of the printing cylinder by means of the flanged bolt 66. The trial plate is then stripped off and remounted on its printing cylinder, the other plates in the set being similarly mounted. All plates will then print in register one with another, in correct axial position on the container and with the overlap joint correctly adjusted.

The layer of pressure sensitive adhesive may be applied to the cylinder instead of to the bottom surface of the flexographic printing plate. Alternatively, the printing plate may be attached to the cylinder by a double sided mounting tape, that is a thin membrane coated on both sides with pressure sensitive adhesive, the tap being applied initially either to the plate or the cylinder. The mounting tape is preferably cut to a size rather larger than the plate and then applied to the cylinder in approximately the position which the plate is to occupy. The adhesive on one side of the tape then attaches the tape to the cylinder and, when the cylinder fitted with the tape is rolled along the plate, the plate becomes attached to the adhesive on the opposite side of the tape and is thereby wrapped around the cylinder.

I claim:

1. A method of mounting flexographic printing plates on the printing cylinders of a multi-cylinder printing machine of the type described, comprising;

stretching one of the flexographic printing plates to a length greater than the length of any of the other printing plates in an unstressed condition, and supporting the plate in the stretched condition on a platform at a precisely predetermined position thereon with the print on the plate facing the platform;

mounting the cylinder at a precisely predetermined position on a rotatable hub having axial and radial abutments engageable with axial and radial abutments on the cylinder, said hub having a precisely predetermined position relative to said platform, the surface of the printing plate facing away from the platform being tangential to the surface of the cylinder;

coating the surface of the cylinder or the last mentioned surface of the printing plate with adhesive;

moving said platform and said hub relative to one another to effect rolling of the cylinder along the stretched printing plate whereby the printing plate adheres to the cylinder at a precisely predetermined position relative to the axial and radial abutments thereon;

removing the cylinder from said hub;

successively stretching each of the other flexographic printing plates to a length precisely equal to that of the first mentioned plate in the stretched condition and on the platform; and successively repeating said mounting, coating, moving and removing steps with each of said other plates and other cylinders, whereby all the printing plates fitted on cylinders have precisely the same length, and the radial and axial abutments on each cylinder fitted with a plate are in the same spatial relationship relative to the area of the plate corresponding to the total design to be printed, so that the printing media on the plates on the cylinders will be in register with one another for printing purposes when the cylinders are mounted on the printing machine.

2. A method as claimed in claim 1, in which each flexographic printing plate is prepared from a design having index marks at opposite ends, each plate including representations of said index marks and parts of the design, wherein each plate is supported on the platform in a stretched condition in which the distance between said index marks is equal to a predetermined length.

3. Apparatus for mounting flexographic printing plates by adhesive on the printing cylinders of a multicylinder printing machine of the type described, the apparatus comprising a base, a hub rotatably mounted on support means on the base, said hub having an axial and radial abutments engageable with axial and radial abutments on a printing cylinder mounted on the hub, a platform on said base, first index means and second index means supported on the platform and engageable with opposite ends of a printing plate for holding the plate in a stretched condition tangential to a printing cylinder mounted on the hub, at least one of said first and second index means being movable along the platform relative to the other of said index means to adjust the distance between the first and second index means and thereby adjust the tension in a printing plate mounted on the index means, both of said first and second index means permitting removal of the plate therefrom in a direction away from the platform, a gear pinion secured to the hub for rotation therewith, and a rack on the platform and in mesh with the pinion, said platform and said hub being relatively movable with the gear pinion rolling along the rack, and the diameter of the pitch circle of the gear pinion being substantially equal to the sum of the diameter of the printing cylinder and the thickness of the printing plate, whereby in operation with said radial and axial abutments on a cylinder engaged against said radial and axial abutments on the hub, a printing plate fitted on the first and second index means with the spacing between the index means adjusted so that the plate is held in a stretched condition, and the cylinder and/or the top surface of the plate coated with adhesive, the plate adheres to and wraps around the cylinder as the cylinder rolls along the plate, with the plate in a predetermined spatial relationship relative to the radial and axial abutments on the cylinder.

4. Apparatus as claimed in claim 3, wherein the printing plate is formed with apertures in the ends thereof, and said first and second index means comprise pins engageable in said apertures.

5. Apparatus for mounting flexographic printing plates by adhesive on the printing cylinders of a multicylinder printing machine of the type described, the apparatus comprising a base, a hub rotatably mounted on support means on the base, said hub having axial and radial abutments engageable with axial and radial abutments on a printing cylinder mounted on the hub, a platform movable along a track on the base, said track being perpendicular to the axis of said hub, two terminal locating blocks mounted on said platform and adapted to support a printing plate tangential to a printing cylinder on said hub, the printing plate having apertures at the ends thereof and the terminal blocks having pins engageable in said apertures, means for moving at least one of said terminal blocks away from the other block to stretch a printing plate engaged on said pins, a gear pinion secured to the hub for rotation therewith, a rack on the platform and in mesh with the pinion, the diameter of the pitch circle of the gear pinion being substantially equal to the sum of the diameter of the printing cylinder and the thickness of the printing plate, whereby in operation with said radial and axial abutments on a cylinder engaged against said radial and axial abutments on the hub, a printing plate fitted on and stretched between the terminal blocks, and the cylinder and/or the top surface of the plate coated with adhesive, the plate adheres to and wraps around the cylinder as the platform moves along said track, with the plate in a predetermined spatial relationship relative to the radial and axial abutments on the cylinder.

6. Apparatus for mounting flexographic printing plates by adhesive on the printing cylinders of a multicylinder printing machine of the type described, the apparatus comprising a base, a hub rotatably mounted on support means on the base, said hub having axial and radial abutments engageable with axial and radial abutments on a printing cylinder mounted on the hub, a platform movable along a track on the base, said track being perpendicular to the axis of said hub, two terminal locating blocks mounted on said platform and adapted to support a printing plate tangential to a printing cylinder on said hub, the printing plate having apertures at the ends thereof and the terminal blocks having pins engageable in said apertures, means for moving at least one of said terminal blocks away from the other block to stretch a printing plate engaged on said pins, an intermediate locating member mounted on said platform and having a pin engageable in an aperture in the center portion of a printing plate supported on said terminal locating blocks, means permitting longitudinal movement of the pin on said intermediate locating member relative to the platform but preventing transverse movement thereto, a gear pinion secured to the hub for rotation therewith, a rack on the platform and in mesh with the pinion, the diameter of the pitch circle of the gear pinion being substantially equal to the sum of the diameter of the printing cylinder and the thickness of the printing plate, whereby in operation with said radial and axial abutments on a cylinder engaged against said radial and axial abutments on the hub, a printing plate fitted on and stretched between the terminal blocks, and the cylinder and/or the top surface of the plate coated with adhesive, the plate adheres to and wraps around the cylinder as the platform moves along said track, with the plate in a predetermined spatial relationship relative to the radial and axial abutments on the cylinder.

7. A method of mounting flexographic printing plates on the printing cylinders of a multi-cylinder printing machine of the type described, comprising:

measuring the length of each printing plate in an unstressed condition, stretching the longest plate by an amount just sufficient to bring it into a taut condition, and supporting the plate in the taut condition on a platform at a precisely predetermined position thereon with the print on the plate facing the platform;

mounting the cylinder at a precisely predetermined position on a rotatable hub having axial and radial abutments engageable with axial and radial abutments on the cylinder, said hub having a precisely predetermined position relative to said platform, the surface of the printing plate facing away from the platform being tangential to the surface of the cylinder.

coating the surface of the cylinder or the last mentioned surface of the printing plate with adhesive;

moving said platform and said hub relative to one another to effect rolling of the cylinder along the printing plate whereby the printing plate adheres to the cylinder at a precisely predetermined position relative to the axial and radial abutments thereon;

removing the cylinder from said hub;

stretching another flexographic printing plate to a length precisely equal to that of the first mentioned plate in the taut condition and mounting the other plate on the platform; and repeating said mounting, coating, moving and removing steps with said other plate and another cylinder, whereby all the printing plates fitted on cylinders have precisely the same length, and the radial and axial abutment on each cylinder fitted with a plate are in the same spatial relationship relative to the area of the plate corresponding to the total design to be printed, so that the printing media on the plates on the cylinders will be in register with one another for printing purposes when the cylinders are mounted on the printing machine.

8. Apparatus as claimed in claim 6, wherein said intermediate locating member comprises a bar extending substantially transversely relative to the platform and pivotally mounted thereto about an axis offset transversely from said pin.

* * * * *